United States Patent [19]

Jeandupeux

[11] Patent Number: 4,804,214

[45] Date of Patent: Feb. 14, 1989

[54] CARPET-KNOTTING APPARATUS

[76] Inventor: Hubert Jeandupeux, Les Périades, CH-1884 Villars-sur-Ollon, Switzerland

[21] Appl. No.: 50,439

[22] Filed: May 13, 1987

[30] Foreign Application Priority Data

May 16, 1986 [CH] Switzerland ..... 02007/86

[51] Int. Cl.[4] ..... D03H 3/00; B65H 69/04

[52] U.S. Cl. ..... 289/17; 139/1 R

[58] Field of Search ..... 289/17; 139/1 R

[56] References Cited

U.S. PATENT DOCUMENTS

| | | | |
|---|---|---|---|
| 2,873,766 | 2/1959 | Jeandupeux | 139/4 X |
| 3,467,145 | 9/1969 | Jeandupeux | 139/1 R |
| 4,423,894 | 1/1984 | Kaufmann | 289/17 |

*Primary Examiner*—Louis K. Rimrodt

*Attorney, Agent, or Firm*—Pollock, Vande Sande & Priddy

[57] ABSTRACT

The apparatus comprises, on the one hand, a head (1) carrying a buckle (8) and a guiding rod (7) ended by a knob (12), and, on the other hand, a unit (13–20) which can freely slide along the rod (7) and which is composed of a hollow handle (13) molded in one piece with a bar (14) to which are jointed two hooks (16, 17), of unequal lengths, and which carries a needle (19). To tie a Smyrna stitch on a canvas, the apparatus, furnished with a pile thread (23), is pushed against the canvas, firstly, so as to fully insert the buckle (8) between two of its threads, and then, so as to cause the movable unit (13–20) to slide along the rod (7), so that the hooks (16, 17) first cause the pile thread (23) to successively pass on both sides of the canvas threads between which the buckle (8) is engaged, and then introduce the ends thereof one after the other in the buckle (8). By completely removing afterwards the apparatus from the canvas, its buckle (8) pulls the ends of the pile thread on the obverse of the canvas while forming the Smyrna stitch.

8 Claims, 4 Drawing Sheets

CARPET-KNOTTING APPARATUS

Figure 1:
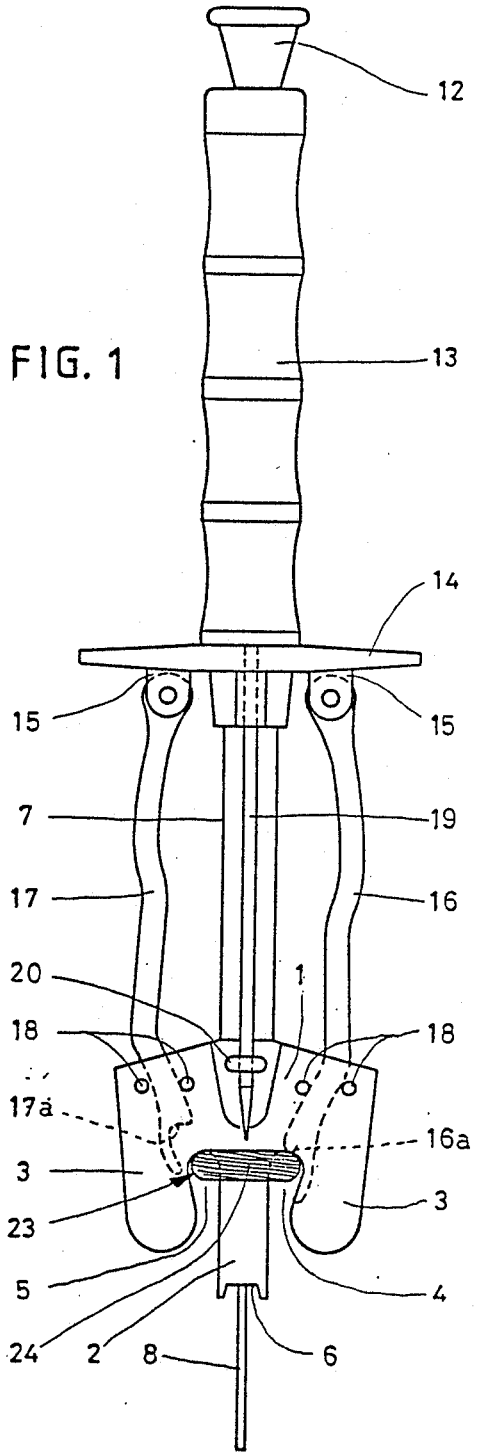

The present invention relates to an apparatus of the type described in the preamble of claim 1. Such an apparatus is disclosed in the Swiss Pat. No. 330,712 [corresponding to U.S. Pat. No. 2,873,766 (note of the translator)]. Engaging that known apparatus in the canvas occurs in two times: a first one, to firstly cause the buckle of the apparatus to pass through the canvas, while keeping the knob at the end of the guiding rod against the handle of the apparatus, and a second one, to cause the hooks to pass together with the pile thread through the canvas while releasing, of course, said knob.

Now, at use, that apparatus more or less rapidly tires the person who uses it to such an extent that some are discouraged and finally give up pursuing that work. The reason for that fatigue is due to the force which must be applied to cause the pile thread to pass through the canvas. It will be observed, indeed, that at the moment at which a hook is going to cause the strand of pile thread it drives to pass through the canvas, the free end of this strand bends back over the hook, so that the latter must push two thicknesses of pile thread through the same opening of the canvas. Since the two hooks of the known apparatus are symmetrical, there are thus four thicknesses of pile thread which must be urged at the same time through the openings of the canvas.

To the resistance that the canvas opposes to that penetration, the friction of the free ends of the pile thread must be added. Those free ends, indeed, must slide in the hooks and against a strand of thread of the canvas as the hooks progressively insert the pile thread into the canvas openings. Moreover, at the moment of that penetration, the outer edges of the hooks bear against the strands of the canvas threads, which are near those between which the buckle of the apparatus is engaged, with such a force that those neighbouring strands are displaced, thereby still increasing the resistance of the canvas to the penetration of the pile thread, in particular in the case of canvas strongly stiffened. Finally, if the apparatus is thrust in an oblique direction with respect to the canvas, it may even happen that either of the strands, near those between which the buckle of the apparatus is engaged, will be sheared.

The invention aims at palliating those drawbacks. Owing to the asymmetry of the hooks, which results from the characteristic of claim 1, those ones cause the strands of pile thread which they drive, to pass one after the other through the canvas. There are thus only two thicknesses of pile thread which pass at one and the same time through the canvas. Moreover, the hook which urges its strand of pile thread through the canvas is no more pressed by the other hook against the strand of the canvas thread adjoining those between which the buckle of the apparatus is engaged. The hooks have thus no longer to distort the canvas upon inserting the pile thread. Finally, the friction of the pile thread ends sliding in the hooks and against a strand of canvas thread is reduced by half, because it is only the friction of one of the pile thread strands which must be overcome at once.

The asymmetry of the hooks of the apparatus according to the invention has thus the effect to reduce in a very large measure the resistance of the canvas to the penetration of the pile thread. In practice, the apparatus according to the invention enters the canvas with ease. It can be pushed therethrough by two fingers, whereas the known apparatus with symmetrical hooks had to be pushed with full hand and, by certain persons, even with both hands.

The special embodiments defined by claim 2 have the advantage that the first strand of pile thread to be introduced into the buckle of the apparatus is protected between its hook and a side wall of the buckle and consequently does not risk to be pushed out of the buckle, when the second strand of that thread is in turn introduced thereinto.

Those defined by claim 3 have the advantage to prevent the pile thread from sliding around the nose of the head of the apparatus instead of sliding in the hooks, for instance in the first one, which firstly seizes a strand thereof, or in consequence of the thickness of the pile thread which is not always regular along that thread.

As regards those defined by claims 4 and 5, they indicate the limits, minimal and maximal, respectively, between which the asymmetry of the hooks preferably should lie.

Without prejudice of the above mentioned advantages of the apparatus according to the invention, it is still possible to avoid another drawback of the known apparatus. The person who used it was, as indicated hereinabove, to bear with the thumb on a knob to cause the buckle of the apparatus to pass through the canvas, then to release that knob to cause the hooks to pass in turn through the canvas. Now, independently of the fact that certain persons sometimes omitted to remove their thumb and bore on the apparatus at the risk of injuring the canvas, the sole obligation to bear on said knob generated, already after some hundreds of stitches, a fatigue in the thumb soon producing cramps. The characteristics defined by claim 6 avoid that fatigue. The person using that particular embodiment of the apparatus according to the invention has no longer to be busy with anything else but holding the handle. Owing to the latching device which automatically releases itself, the buckle of the apparatus firstly enters the canvas alone and the hooks are only liberated at the moment at which the buckle arrives at the end of its stroke. To execute a Smyrna stitch, that apparatus thus has only to be pushed against the canvas and then to be pulled out after having reached the end of its stroke.

Finally, the particular embodiments defined by claim 7 have the advantage to reduce still more the friction on the entry of the second strand of pile thread into the buckle of the apparatus. The coefficient of friction of the pile thread is, indeed, distinctly smaller with the metal of the partition of the buckle than with the other strand of the pile thread. The partition of the buckle has also the advantage to avoid that the two strands of pile thread rub against each other at the risk of coming untwisted.

Figure 2:
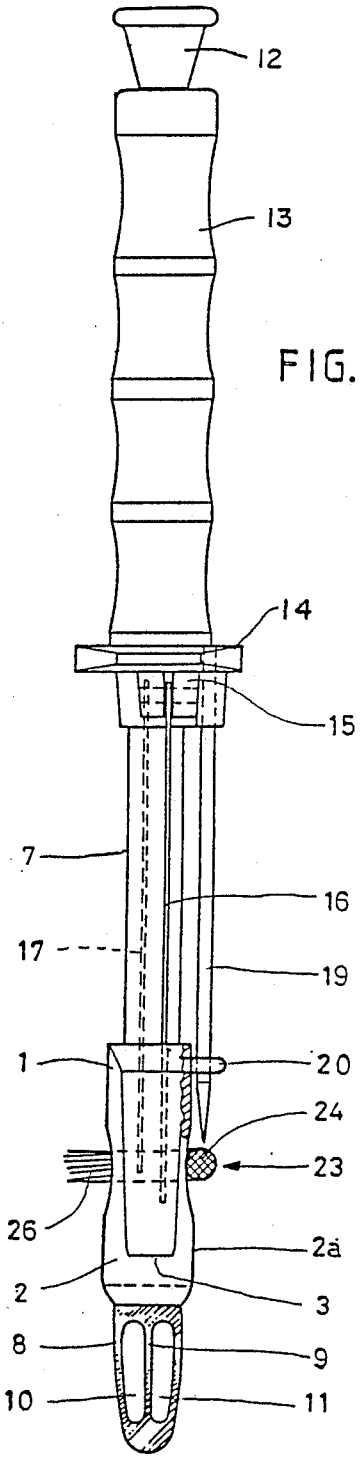
Figure 7:
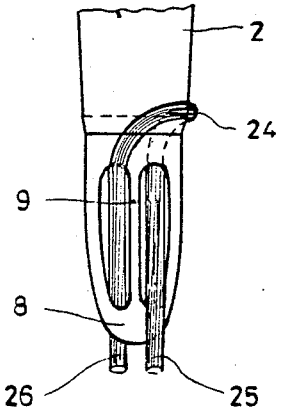
Figure 8:
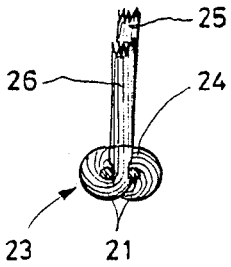
Figure 9:
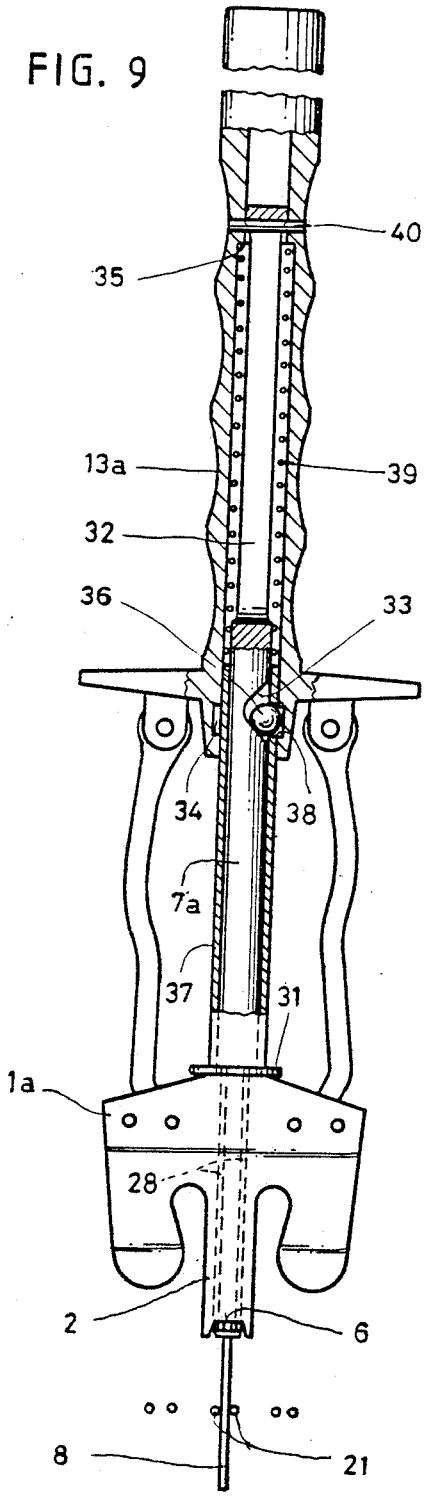
Figure 10:
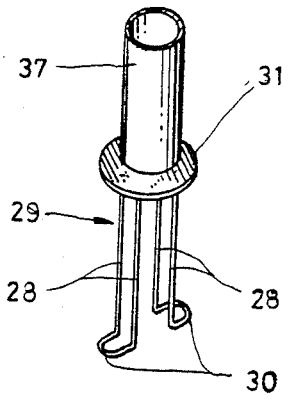
Figure 11:
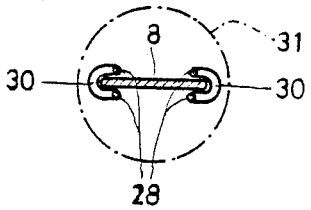
Figure 12:
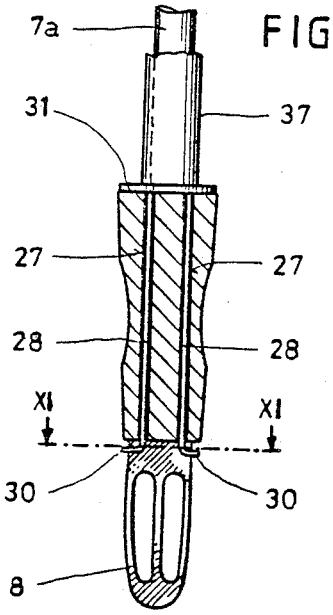
Figure 13:
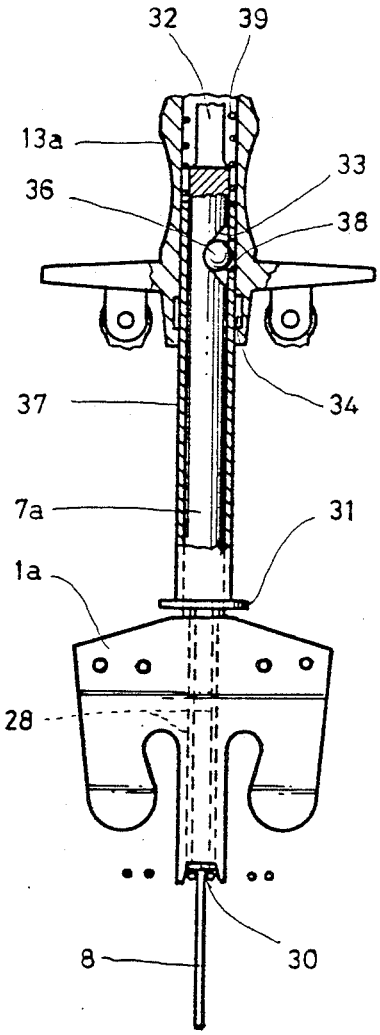

Two embodiments of the apparatus according to the invention are represented diagrammatically and merely by way of example in the drawing, in which:

the FIG. 1 is an elevational view of the rear face of the first embodiment, the apparatus being ready to tie a Smyrna stitch;

the FIG. 2 is a side view of the apparatus of FIG. 1;

the FIGS. 3 to 6 represent a part of the front face of the apparatus of the FIG. 1 at different successive stages of operation;

the FIG. 7 represents a part of the apparatus of the FIG. 2 at a later stage of operation;

the FIG. 8 shows the terminated Smyrna stitch;

the FIG. 9 is a front view, partly in section, of the second embodiment at rest;

the FIG. 10 is a perspective view of a part of the FIG. 9;

the FIG. 11 is a cross-section on a larger scale along line XI—XI of the FIG. 12.

the FIG. 12 is a side view partly in section of another part of the FIG. 9, and the FIG. 13 is a partial view of the FIG. 9 in a position in the course of the operation.

The apparatus according to the first embodiment (FIGS. 1 and 2) comprises a head 1 molded in a synthetic material. That head is provided with a nose 2 and two cheeks 3 which extend on both sides of nose 2 so as to form two lodgings 4, 5. The end 6 of nose 2 has a concave shape.

The head 1 is solid with a guiding rod 7 and its nose carries an elongated and rigid buckle 8, those two last pieces preferably being metallic. As shown in FIG. 2, the buckle 8 has a longitudinal partition 9 in the middle of its width, which defines two compartments 10, 11. The partition 9, is, however, not indispensable to the good operation of the apparatus. A knob 12 is fixed at the end of the rod 7.

The apparatus still comprises a unit which can freely slide along the rod 7. That unit comprises a hollow handle 13 molded in one piece of synthetic material with a bar 14. The latter has two pegs 15 to which are jointed metallic hooks 16, 17 lying in different planes. The ends 16a, 17a of those hooks are engaged in grooves (not shown) of cheeks 3. Each hook is guided in those grooves by a pair of pins 18, which are driven through the cheeks 3.

The FIG. 1 shows that the end 16a of hook 16 is nearer to lodging 4 than the end 17a of hook 17 to lodging 5. In the embodiment represented, that result is obtained by a hook 16 longer than hook 17. The result would however be the same with two identical hooks, if one of them would be jointed to a point of bar 14 farther away than the other.

A needle 19 is still fixed to that bar 14 and an eyelet 20, solid with the head 1 guides its end. That eyelet 20 could also be made in one piece in form of a thread, conveniently bent, integral with the pins 18. The FIG. 2 shows that the hook 16, the longer one, is on the side of the needle 19. When looking at the front face of the apparatus, the hook 16 thus is behind the hook 17.

The disclosed apparatus is intended for forming Smyrna stitches on a canvas composed of pairs of warp and weft threads close to one another. Those thread pairs are regularly spaced from one another so as to define square openings between them. One pair of weft threads 21 and one thread 22 of the adjacent pairs are represented in section in the FIG. 3 to 6. The threads 21, 22 are naturally comprised between two adjoining pairs of ward threads (not shown). One finds on the market canvases of that type with warp and weft threads more or less thin and openings more or less large.

To form a Smyrna stitch on a predetermined canvas of the type described by means of the apparatus according to the invention, a pile thread 23 of predetermined length and a size adapted to that convas is folded double and inserted into lodgings 4, 5 while holding its ends against each other between the thumb and the forefinger, in front of the apparatus. Its mid portion 24 is thus at the rear of the apparatus, whereas its strands 25, 26 stand away from the head 1, in front thereof, in directions approximately parallel.

To avoid that the pile thread will be placed on the wrong side of the apparatus, with its mid portion 24 on the front face of the head 1, an obstacle can be arranged at the rear of the apparatus. Thus, instead of an eyelet 20, made in one piece with the pins 18, the latter could also be made in one thread-like piece comprising a U-shaped part, the legs of which, at a distance from each other smaller than the diameter of the needle 19, would extend along the latter, down to the vicinity of the end 6 of nose 2, the rounded end of that U-shaped part being bent away from head 1 to the rear thereof. The projection constituted by that bent part, which can be beyond the cheeks 3, would prevent the fingers holding the ends of the pile thread to come near enough to nose 2 for causing the portion 24 of that thread to pass on front of the head 1, i.e. on the wrong side of the apparatus.

A pile thread is correctly placed on the apparatus represented in the FIGS. 1 and 2. The latter is ready to tie a Smyrna stitch on the canvas. For this purpose, the apparatus is inserted into the canvas. That engagement comprises two times.

In a first time, the buckle 8 is introduced between the two strands of the pair 21 of weft threads close together, than thoroughly pushed through the canvas. In that position, represented in FIG. 3, the two strands of the pair 21 are imprisoned on the bottom of the concavity at the end 6 of nose 2 of the head 1. That measure takes its full sense in the case of canvases little or not stiffened or in those in which the stiffening has more or less disappeared; it actually avoids that one or the other strand of the pair 21 will be seized and possibly cut by the hooks 16, 17 during the next time of the operation. During all the first time described, i.e. until the buckle 8 has reached the position of FIG. 3, the knob 12 must be maintained applied against the handle 13. If the latter is held by the full hand, the knob 12 will be maintained against the handle 13 by the thumb.

Figure 3:
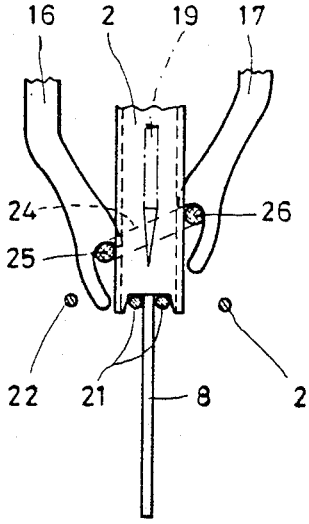

The person using the apparatus perceives the arrival of the buckle 8 in the position of the FIG. 3 at the resistance that the strands of the pair 21 of the canvas then oppose to the advance of the apparatus against the canvas. At that moment, she must liberate the knob 12 to effect the second time of the engagement of the apparatus in the canvas, and start causing the handle 13 to slide along rod 7. The hook 16, the longer one, then seizes the portion of the pile thread 23, which is engaged in the lodging 4 and starts pushing the strand 25 against the canvas, while sliding along that strand 25, toward its end. A moment later, it is the hook 17 which in turn seizes the portion of the pile thread 23 engaged in the lodging 5. The pile thread 23 thus comes in the inclined position represented in the FIG. 3. Simultaneously, the point of the needle 19, which is in the vicinity of the mid portion 24 of the pile thread 23, starts driving into that portion.

Figure 4:
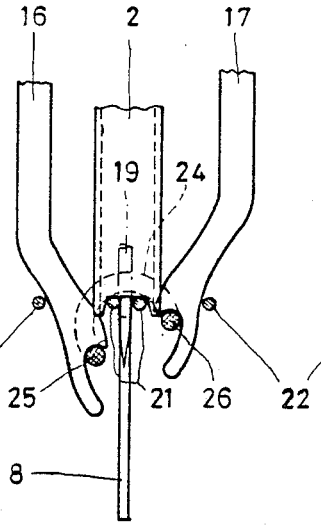

When the forward movement of handle 13 along rod 7 continues, the hooks 16, 17 cause the two strands 25 and 26 of the pile thread to successively pass through the openings comprised between the strands of the pair 21 of weft threads and strands 22 of the adjoining pairs of weft threads. At the same time, the hooks 16, 17 cause the mid portion 24 of the pile thread 23 to slide along nose 2, until that portion lies on the canvas (FIG. 4).

The needle 19 contributes to cause the portion 24 of the pile thread to slide along nose 2, but it prevents that thread from turning around that nose—for instance under the pull exerted by the hook 16 on the strand 25 of the pile thread—, not only because it stands in that portion 24, but because it additionally presses the part comprised between it and the bulging *2a* of nose 2.

When passing through the canvas openings, the ends of strands 25, 26 of the pile thread 23 naturally bent themselves around the corresponding hooks 16, 17. Each hook thus pushes two thicknesses of pile thread through the corresponding opening of the canvas.

When the hook 16 enters the corresponding opening of the canvas, it is guided therein by the strand of weft thread 22 of the adjoining pair, but it does not exert a particular pressure against that thread 22, which could deform it by urging it away from pair 21, because the hook 17 has not yet entered the canvas. When it is the turn of that hook 17 to enter the corresponding opening of the canvas, it is guided threin under the same conditions by the strand 22 of weft thread of the adjoining pair, since at that moment, the hook 16 has already passed through the canvas. All the time during that penetration, the hooks 16, 17 naturally continue to progressively slide along their corresponding strands 25, 26 of the pile thread, toward the ends of those strands.

In order that the apparatus operates in the manner which has just been described, it is recommended that the divergence between the ends of the hooks be at least equal to the thickness of the pile thread, so that the hook 16 will have caused the strand 25 of the pile thread to pass through the canvas when the hook 17 is going to cause the strand 26 of that thread to pass therethrough.

With respect to an apparatus with symmetrical hooks, that according to the invention encounters substantially less resistance to passing the pile thread 23 through the canvas, firstly because the strands 25, 26 of that pile thread 23 are successively and not simultaneously pushed through the canvas and then because the hooks 16, 17, which do not enter the canvas at the same time, have not to push away from one another the strands of weft threads 22 adjoining the pair 21. Furthermore, when the hook 16 causes the strand 25 of the pile thread 23 to pass through the canvas, the end of that strand 25, which is bent around the hook 16, slides in that hook, whereas the remaining portion of thread 23 is immobilized around nose 2 of the head 1 by the needle 19, which, at that moment, has crossed the portion 24 of thread 23. Thus, when the hooks 16, 17 arrive in the position of the FIG. 4, the strands 25, 26 of the pile thread 23 have the same length.

Figure 5:
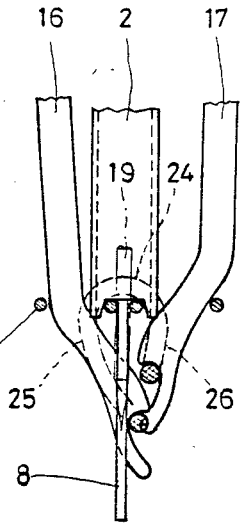

The FIG. 5 represents the moment of the advance of the movable unit of the apparatus at which the hook 16 has introduced the strand 25 of the pile thread 23 into the compartment 11 of the buckle 8, whereas the hook 17 is going to introduce the strand 16 of the pile thread into the compartment 10 of that buckle. Like for the passage through the canvas, the end of strand 25 of the pile thread 23 has also been bent around the hook 16 at the entry in compartment 11 of the buckle 8.

When that bent end of strand 25 is completely in compartment 11, it stands up straight again and leaves the hook 16. Since the hook 16 is then behind the hook 17, that strand 25 is between the hook 16 and the rear side wall of the buckle 8 and not between the two hooks. When the hook 17 in turn causes the strand 26 of the pile thread to enter the compartment 10 of the buckle 8 (FIG. 6), that strand cannot come in contact with the strand 25, although it is between the two hooks. It could at most rub against the end of strand 25 still bent around hook 16, if the buckle were not partitioned.

Figure 6:
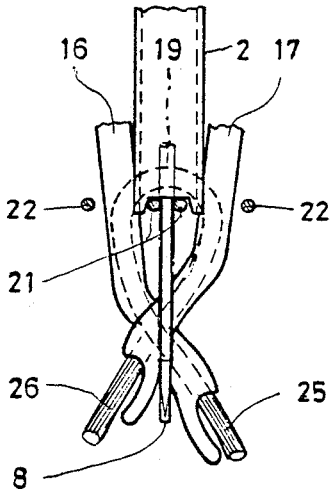

In the position of FIG. 6, the movable unit is at the end of its stroke. The apparatus is thus fully engaged in the canvas, at the end of the second time of the displacement of the apparatus toward the canvas.

It is important that the hook 17, the shorter one, should nevertheless be long enough in order that, at the end of the forward stroke, it causes the end of strand 26—which is bent around that hook at the entry in the buckle 8—to entirely pass in that buckle so that it may stand up straight again and leave the hook 17. If the end of strand 26 remained bent around hook 17 at the end of the forward stroke, the latter could drive the strand 16 out of the buckle 8 when it is retired.

The partition 9 of the buckle 8 hinders any contact between the strands 25 and 26 of the pile thread in the buckle. Pile threads, even not specially treated, do thus not risk to get untwisted upon rubbing against each other. Furthermore, the frictions of the end of strand 25, bent around the hook 16, and of the strand 26 against the partition 9, are smaller than those of those strands against each other.

In the position of FIG. 6, the person using the apparatus according to the invention has then only to remove it from the canvas to form a Smyrna stitch. During a first time of the retracting motion, the movable unit 13–20 moves back toward the knob 12 while removing the hooks 16, 17 from the buckle 8 and bringing them back in their position of rest represented in FIG. 1. At the end of that first time, the buckle 8 is still fully engaged in the canvas with the strands 25 and 26 of the pile thread 23 in its compartments 10, 11, as shown in FIG. 7.

During a second time of the retracting motion, the buckle 8 is removed from the canvas while driving with it the two strands 25 and 26 between the two strands of the pair 21 of weft threads. It results therefrom the Ghiordès knot or Smyrna stitch represented in FIG. 8.

In that last Figure, the strands 25 and 26 of the pile thread 23 will constitute the rug pile, when tying the stitches will be ended on the considered canvas. As regards the mid portion 24 of thread 23, which is wound around the two weft threads of the pair 21, it forms the actual knot. The piles 24, 25 are thus juxtaposed along the narrow space delimited, on the one hand, by the two strands of weft thread of the pair 21, and, on the other hand, by the adjacent pairs of warp threads (not shown) of the canvas. The mid portion 24, for its part, of the pile thread 23, passes over one of the pairs of warp threads delimiting the space in which are the piles 25, 26. The FIG. 8 still shows that the piles 25, 26 are strangled by the strands of the pair 21 of weft threads, thereby perfectly blocking the knot thus formed.

Summing up, the described apparatus permits to form a Smyrna stitch simply by pushing it thoroughly against the canvas, after having set around its nose 2 a strand of pile thread, previously cut to the desired length, and then by retiring it completely from the canvas. Until the buckle 8 has thoroughly passed through the canvas, the knob 12 must, however, be kept against the handle 13. Packings of strands of pile threads of different colors, lengths and sizes are for sale on the market.

The second embodiment (FIGS. 9 to 13) is more elaborated, accordingly somewhat more expensive than the first one; but it has the great advantage to relieve the person who utilizes it of a movement and to spare her the fatigue that it involves. For that purpose, that second embodiment differs from the first one only by the presence of a latching device with ball, which locks the movable unit along the guiding rod as long as the partitioned buckle enters the canvas, but which automatically releases that unit, as soon as the buckle is fully engaged in the canvas.

To mount the latching device with ball on the apparatus according to the invention, the head, the guiding rod which is solid therewith and the handle of the apparatus must however be slightly modified. Accordingly, the head 1*a* is provided with four bores 27 which cross it in a parallel direction with the axis of the apparatus and open in the bottom of the concavity of the end 6 of its nose 2. Four equally long legs 28 of a metallic releaser 29 (FIG. 10) extend through bores 27 in which they can freely slide. Each pair of legs 28 constitutes the down strokes of a "U", the rounded base 30 of which is bent at right angle so as to surround the base of the buckle 8 (FIG. 11). At rest (FIGS. 9 and 12), bases 30 are some distance apart from the bottom of the concavity of the end 6 of the nose 2. The end of legs 28 are fixed to a flat ring 31, which, in the position of FIGS. 9 and 12, lies on the head 1*a*.

On its part, the guiding rod 7*a* is provided, on the one hand, with a diametrical slot 32 having a length equal to the stroke of the movable unit of the apparatus, and, on the other hand, with a notch 33 having walls in form of a cylindrical surface. As regards handle 13*a*, it is provided with a internal groove 34 and with a shoulder 35. It is longer than that of the first embodiment and its upper end is closed.

Besides the pieces, moreover identical with those of the first embodiment, the apparatus according to the second embodiment still comprises a ball 36 located in the notch 33 and a sleeve 37 adjusted on the guiding rod 7*a* so as to be able to freely slide therealong. The sleeve 37 is provided with a lateral opening 38 and it is placed under the action of a coiled return spring 39 which is located in the handle 13*a*, around the guiding rod 7*a*, and bears against the shoulder 35 to thrust the sleeve 37 against the head 1*a*. Finally, a pin 40 is drived across the handle 13*a* and it freely extends through the slot 32 of the guiding rod 7*a*.

In the position of rest of FIG. 9, the spring 39 urges the movable unit 13–20 away from the head 1*a*. It causes the pin 40 to butt against the upper end of the slot 32 and the ring 31 to butt against the head 1*a* by means of the sleeve 37. In that position, the edges of the opening 38 of the sleeve 37 remove the ball 36 from the bottom of the notch 33 and keep it engaged in groove 34, thereby locking the handle 13*a* to the guiding rod 7*a* and consequently locking the movable unit and the head 1*a* to one another.

When the apparatus is pushed by means of the handle 13*a* in order to insert its buckle 8 between the weft thread strands of the pair 21, the ball 36, wedged up in groove 34, compels the head 1*a* and consequently the buckle 8 to follow the thrust exerted on the handle 13*a*.

At the moment at which the buckle 8 will be fully engaged in the canvas, the bases 30 of the releaser 29 come in contact with the weft thread strands of the pair 21 of the canvas. Those bases 30 are then pushed against the bottom of the concavity of the end 6 of the nose 2, as shown in FIG. 13. Consequently, the legs 28 move the ring 31 away from the head 1*a* while pushing the sleeve 37 against the action of the spring 39. During that movement of the sleeve 37, its opening 38 drives the ball 36 toward the bottom of the notch 33 while causing it to move out of the groove 34, thereby having the effect to release the handle 13*a* and consequently the movable unit from the guiding rod 7*a*, thus from the head 1*a*. That unit can then move toward the head 1*a* as was the case in the first embodiment, after having released the knob 12. That forward movement continues until the pin 40 butts against the lower end of the slot 32, i.e. until the apparatus is fully engaged in the canvas.

The person using the apparatus represented in FIGS. 9 to 13 has thus neither to get tired by holding a knob nor to be careful to release it at the proper moment. She has only to push the apparatus until it will be fully engaged in the canvas, and then to remove it completely therefrom. The latching device with ball described automatically ensures the operation which had to be manually exerted on the knob 12 of the first embodiment.

When the apparatus according to the second embodiment has been removed from the canvas, the spring 39 naturally brings it back in the position of rest of the FIG. 9.

I claim:

1. Apparatus to tie Smyrna stitches called Ghiordes knots on a canvas, comprising, on the one hand, a head which presents a nose and two cheeks delimitating two lodgings between them and said nose, the back part of the head being arranged to receive the mid portion of a pile thread of predetermined length, while the portions of that thread, adjacent to that mid portion, are imprisoned in said lodgings so that the ends of that thread extend in front of the head in approximately parallel directions, that head being solid with a guiding rod and its nose carrying a rigid buckle intended to pass between two threads of the canvas in the course of a first movement of engagement of the apparatus, and, on the other hand, a unit movable along said rod, between a position of rest and an engaged position, that unit carrying two hooks which are located in different planes, parallel to each other and move in those planes, when said unit moves from its position of rest to its engaged position and vice versa, which are guided by said head and which, in the course of a supplementary movement of engagement, leave their position of rest, cross the canvas by passing through openings of the latter, located on either side of the two said threads between which the buckle of the apparatus has been engaged, and finally cross each other in said buckle, when they reach the engaged position, those hooks being intended, in the course of their displacement, for seizing the portions of the pile thread imprisoned in said lodgings and, while sliding along said thread toward its ends, for causing the ends to pass through said openings of the canvas in order to finally deposit them in said buckle, which, in the course of the disengagement of the apparatus, pull those ends of the pile thread between the two said threads of the canvas, characterized in that the parts (16*a*, 17*a*) of the hooks (16, 17), which seize the portions of the pile thread (23) imprisoned in said lodgings (4, 5), are not at the same distance from those portions of the pile thread, so as to seize them one after the other, during the supplementary movement of engagement of the apparatus, to cause the ends of that thread (23) to successively pass through the canvas and to engage them one after the other into said buckle (8), when coming near their engaged position.

2. Apparatus according to claim 1, characterized in that the hook (16), which is intended for firstly seizing the pile thread (23), is located in that of the planes of the hooks (16, 17) which is on the rear of the head (1).

3. Apparatus according to claim 2, characterized in that said unit (13–20) also carries a needle (19), the point of which, located on the rear face of the head (1) in the position of rest of the apparatus, is intended for penetrating through the mid portion (24) of the pile thread (23) located on said head, when the first hook (16) to seize that pile thread (23) starts sliding along that thread.

4. Apparatus according to claim 3, characterized in that the difference between the distances, through which, at rest, the parts (16*a*, 17*a*) of hooks (16, 17) intended for seizing the portions of the pile thread (23) engaged in said lodgings (4, 5) are set apart from those portions of the pile thread, is at least equal to the thickness of that thread.

5. Apparatus according to claim 3, characterized in that the difference between the distances through which, at rest, the parts (16*a*, 17*a*) of hooks (16, 17) intended for seizing the portions of the pile thread (23) engaged in said lodgings (4, 5) are set apart form the portions of the pile thread, is at most limited by the fact that the hook (17) seizing that thread in second place must, in the engaged position, penetrate into said buckle (8) to a sufficient extent in order to cause full entering thereinto of the portion (26) of the pile thread (23) which it seized.

6. Apparatus according to anyone of the claims 1 to 5, characterized in that it comprises a control handle (13*a*) solid with said unit, a latching device with ball (33 to 39) which normally locks the handle (13*a*) and that unit with respect to said head (1*a*), and a releaser (29) protruding from the end (6) of said nose (2), at the basis of said buckle (8), that releaser (29) releasing said latching device (33 to 39) when the buckle (8) has crossed the canvas and when its protruding portion (30) comes in contact with the latter.

7. Apparatus according to anyone of the claims 1 to 5, characterized in that said buckle (8) is provided with a longitudinal partition (9) approximately in its middle.

8. Apparatus according to anyone of the claims 1 to 5, characterized by a projection located at the rear of the head (1) and constituting an obstacle to setting in place a pile thread on the wrong side of the apparatus.

* * * * *

UNITED STATES PATENT AND TRADEMARK OFFICE

CERTIFICATE OF CORRECTION

PATENT NO. : 4,804,214

DATED : February 14, 1989

INVENTOR(S) : Hubert Jeandupeux

It is certified that error appears in the above-identified patent and that said Letters Patent is hereby corrected as shown below:

Column 9, line 20, change "form" to --from--.

Signed and Sealed this

Twelfth Day of September, 1989

*Attest:*

DONALD J. QUIGG

*Attesting Officer*

*Commissioner of Patents and Trademarks*